US009238930B2

(12) United States Patent
Tuyen

(10) Patent No.: US 9,238,930 B2
(45) Date of Patent: Jan. 19, 2016

(54) LOCKING SYSTEM WITH MULTIPLE LATCHES

(71) Applicant: Capitol Development, LLC, Sunrise, FL (US)

(72) Inventor: Phan Quang Tuyen, Ho Chi Minh (VN)

(73) Assignee: CAPITOL DEVELOPMENT, LLC, Sunrise, FL (US)

( * ) Notice: Subject to any disclaimer, the term of this patent is extended or adjusted under 35 U.S.C. 154(b) by 196 days.

(21) Appl. No.: 13/708,394

(22) Filed: Dec. 7, 2012

(65) Prior Publication Data

US 2014/0159385 A1 Jun. 12, 2014

(51) Int. Cl.

| | |
|---|---|
| ***E05C 1/12*** | (2006.01) |
| ***E05C 9/18*** | (2006.01) |
| ***E05B 53/00*** | (2006.01) |
| ***E05B 65/00*** | (2006.01) |
| ***E05B 65/46*** | (2006.01) |

(52) U.S. Cl.

CPC ..... *E05C 9/1833* (2013.01); *E05B 53/005* (2013.01); *E05B 65/0003* (2013.01); *E05B 65/462* (2013.01); *Y10T 292/0962* (2015.04)

(58) Field of Classification Search

CPC . E05B 53/005; E05B 65/462; E05B 65/0003; E05C 9/1833; Y10T 292/0962

USPC ..... 292/157, 32, 33, 37, 40, 38, 42, 137, 292/138, 163, 171, 175, 140, 145; 74/500.5

See application file for complete search history.

(56) References Cited

U.S. PATENT DOCUMENTS

| | | | | |
|---|---|---|---|---|
| 2,022,718 | A * | 12/1935 | Heins | 292/38 |
| 2,717,169 | A * | 9/1955 | Lindbloom | 292/144 |
| 3,270,151 | A * | 8/1966 | Godette | 200/43.08 |
| 4,288,944 | A * | 9/1981 | Donovan | 49/395 |
| 4,469,382 | A * | 9/1984 | Slaats et al. | 312/219 |
| 5,862,692 | A * | 1/1999 | Legault et al. | 70/278.1 |
| 6,546,765 | B1 * | 4/2003 | Linares | 70/210 |
| 6,748,776 | B2 * | 6/2004 | Bullock et al. | 70/212 |
| 2002/0162369 | A1 * | 11/2002 | Lurie et al. | 70/256 |
| 2004/0036387 | A1 * | 2/2004 | Ludwig et al. | 312/221 |
| 2007/0159038 | A1 * | 7/2007 | Huang | 312/333 |

FOREIGN PATENT DOCUMENTS

| | | | |
|---|---|---|---|
| DE | 4323257 | A1 | 1/1995 |
| DE | 20120473 | U1 | 3/2003 |
| FR | 1128390 | A | 1/1957 |
| FR | 2931186 | A | 11/2009 |

OTHER PUBLICATIONS

International Search Report for PCT/US2013/039935.

* cited by examiner

*Primary Examiner* — Kristina Fulton
*Assistant Examiner* — Christine M Mills

(57) ABSTRACT

A locking system provides multiple lockable latching mechanisms that are collectively operable and lockable from a central actuation mechanism. Each latching mechanism can be positioned and actuated independent of the positioning of others of the latching mechanisms. In particular, the latching mechanisms need not be aligned with one another. The system uses flexible connectors between the central actuation mechanism and the respective latching mechanisms. The flexible connectors can have different respective lengths.

25 Claims, 5 Drawing Sheets

LOCKING SYSTEM WITH MULTIPLE LATCHES

FIELD OF THE INVENTION

The present invention generally relates to locking systems with multiple lockable latch mechanisms, the latch mechanisms each being actuable from a common central actuation mechanism. The invention more particularly relates to a locking system in which the each of the lockable latch mechanisms can be positioned for operation independently of the position of others of the lockable latch mechanisms.

BACKGROUND OF THE INVENTION

A conventional locking system most generally provides a single locking point between two structures, such as a file drawer relative to the cabinet in which the file drawer is disposed, a door relative to its door frame, and so on. Examples of such locking systems include a deadbolt lock or a lockable door knob for doors, or a locking cylinder (for example, key-actuated) that drives a bar or pin into a locking position for obstructing, for example, a drawer from being opened.

It is also conventionally known to operate several locking points in unison from a central location, such as using a single key to lock multiple file drawers in a vertical filing cabinet at the same time. However, such locking systems usually require a restrictive degree of proximity or alignment or both between the locking points (and, thus, between the elements being locked such as the drawers in this example). For example, a conventional single key lock for multiple drawers in a filing cabinet uses a linearly elongate bar or other rigid member that generally extends or spans across all of the drawers and is selectively moved between locked and unlocked positions by actuation of the key. Such restrictions as to proximity and/or alignment in conventional lock systems limit their usefulness if the required locking positions are distant from one another and/or are spaced apart in several dimensions.

SUMMARY OF THE INVENTION

The present invention relates to a locking system with multiple lockable latch mechanisms and a central actuation mechanism operably connected to each of the latch mechanisms. The latch mechanisms characteristically can be positioned where needed with more flexibility than in conventional locking systems. In particular, the present invention uses flexible connectors between the central actuation mechanism and the respective latch mechanisms. These flexible connectors can each have different lengths and permit each latching mechanism to be placed in a variety of positions relative to the central actuation mechanism, independent of the positioning of the other latching mechanisms.

BRIEF DESCRIPTION OF THE DRAWINGS

The present invention will be even more clearly understandable in view of the written description herein and the figures appended hereto, in which.

Figure 3C:
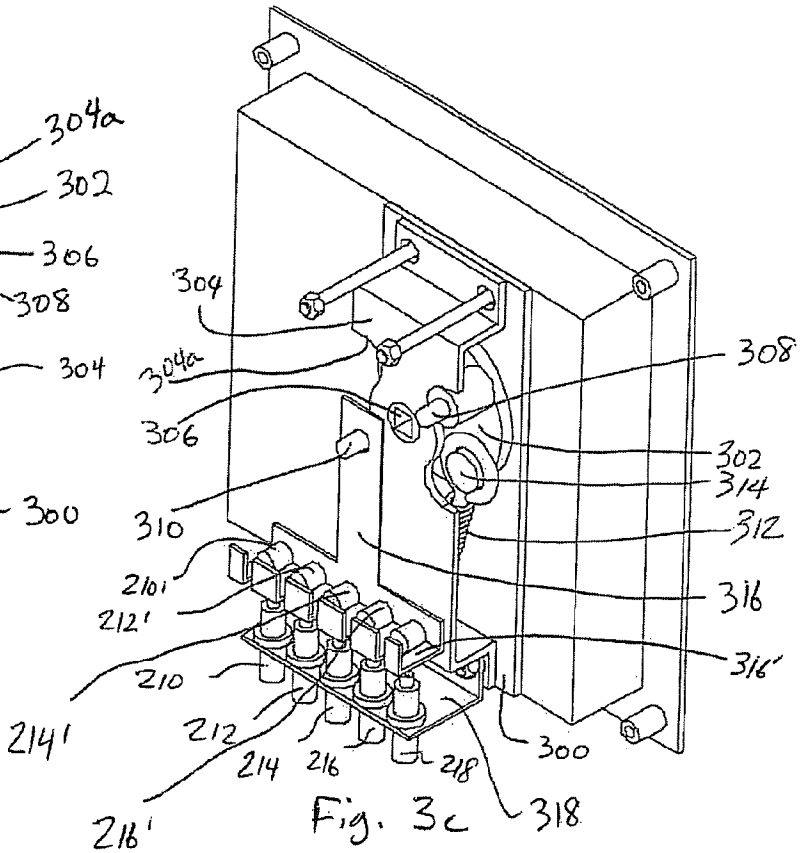
FIGS. 3*a*, 3*b*, and 3*c* are side, partial plan, and partial perspective views of an interior portion of an example of a central actuation mechanism of the locking system provided in the storage cabinet illustrated in FIGS. 1 and 2.
Figure 3B:
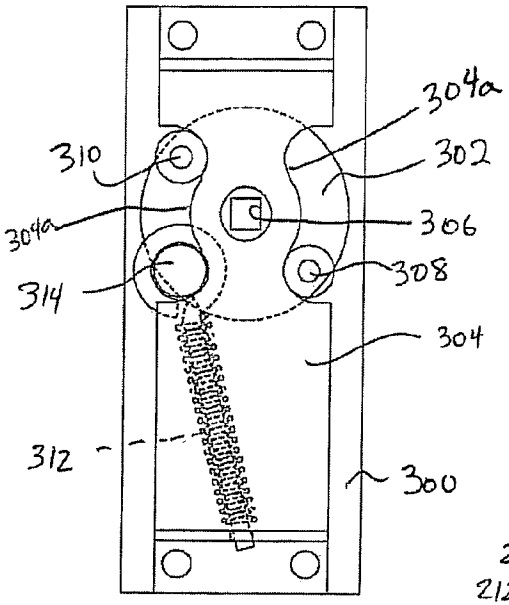
Figure 3A:
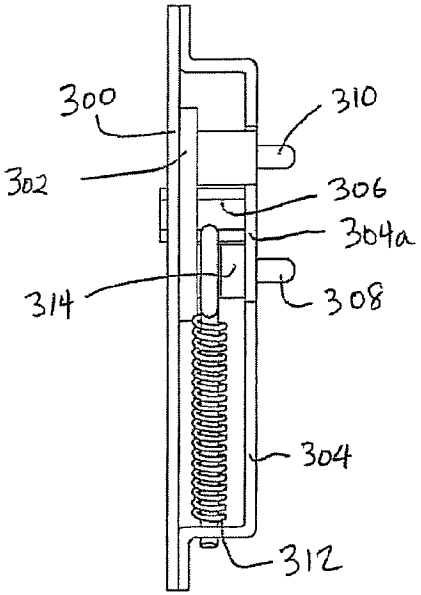

It is noted that not all of the Figures are drawn to the same scale, including elements shown in multiple-part figures (for example, in FIGS. 3*a*-3*c*).

DETAILED DESCRIPTION OF THE INVENTION

Figure 1:
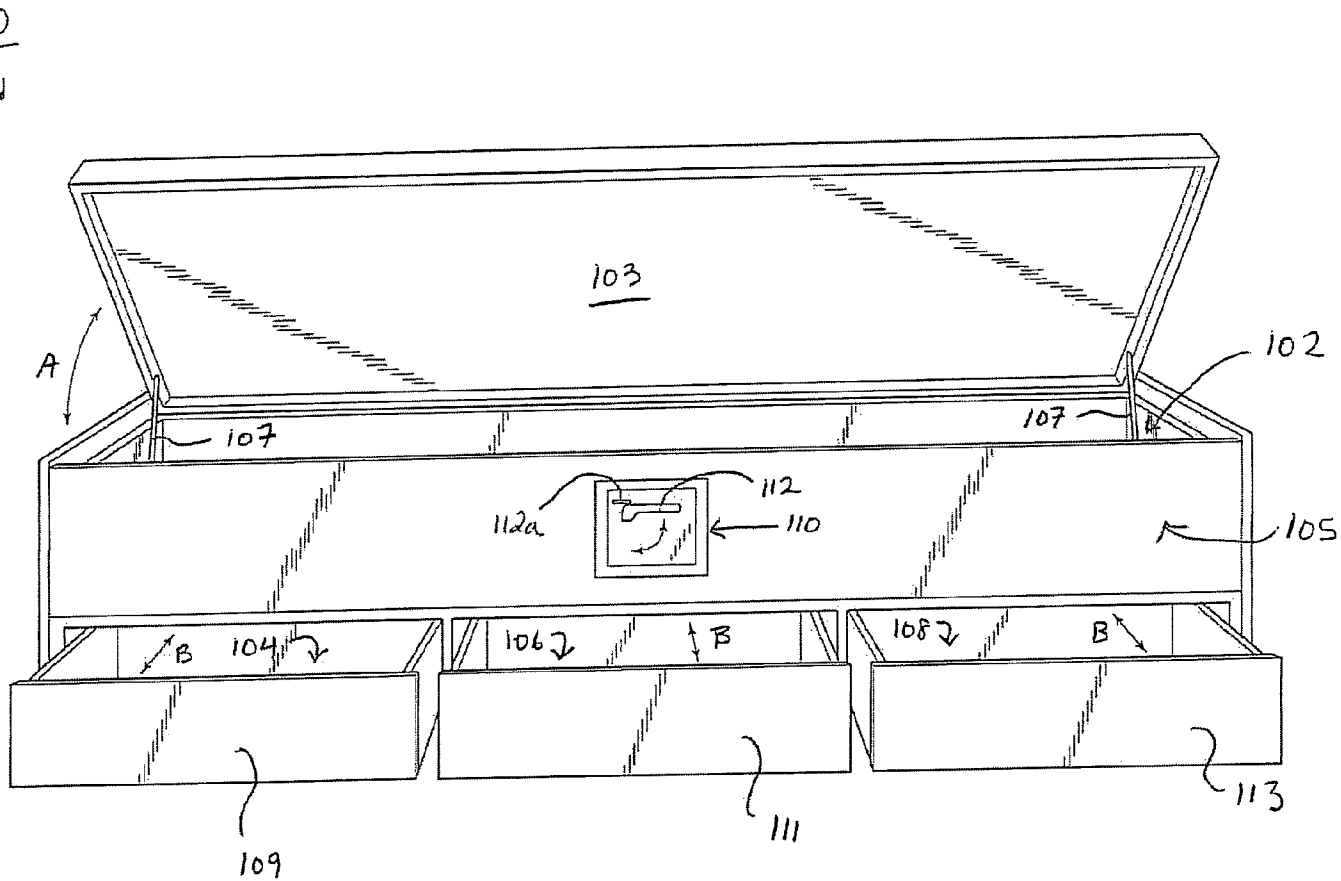
FIG. 1 is a perspective view of a storage cabinet, used here as an example implementation of the present invention.

Strictly by way of example for illustrating the concept of the present invention, FIG. 1 illustrates a storage cabinet 100 having a plurality of independently accessible storage spaces. It is emphasized that the mention of a storage cabinet here is merely an example of how the locking system of the present invention can be used, and the present invention will be easily understood to be applicable to other structural arrangements in which a plurality of locking points must be provided. As used herein, the term "locking point" is a most general reference to a physical location where some type of lock or lockable latch mechanism is provided between two physical elements.

Storage cabinet 100 may include an upper first storage space 102 that can be selectively closed by way of an upwardly swinging (see arrow A) door or lid 103 that is hinged or otherwise pivotably mounted in a conventional manner (not illustrated) to cabinet body 105. If desired or useful (for example, if lid 103 is relatively heavy or must be held open without manual support), one or more support members (such as conventional gas pistons) 107 can be provided in a known manner to at least partly support the weight of lid 103 and/or keep lid 103 in an open position.

Storage cabinet 100 may further include one or more additional lower storage spaces. In FIG. 1, for example, storage cabinet 100 further includes three selectively extensible (see arrows B) drawers 109, 111, 113 defining therein lower storage spaces 104, 106, 108, respectively. The number of lower storage spaces provided is strictly by way of example, and the provision of drawers, as such, is also by way of example. For example, the lower storage space or spaces could be accessible by way of a corresponding number of hinged or otherwise pivotably mounted doors. The relative arrangement of the plurality of storage spaces can also vary in accordance with the present invention.

As explained in further detail below, the lid 103 and drawers 109, 111, 113 can be latched (i.e., not necessarily locked) and, if desired, locked closed by way of a single central actuation mechanism 110. In an example, a pivoting handle 112 can be operated to latch (although not necessarily lock) the lid and drawers closed. Thereafter, the handle 112 itself can be locked in the latched position if desired. For example, a padlock or the like (not shown) can be passed through aligned openings 117 in handle 112 and 117*a* in an eye member 112*a* (see FIGS. 4*a* and 4*b*). In another illustrative example (not illustrated here), a key-operated lock cylinder can be provided in the handle 112 itself to selectively prevent rotation of the handle 112 (in a manner similar to conventional door knobs and door handles provided with locks).

Figure 2:
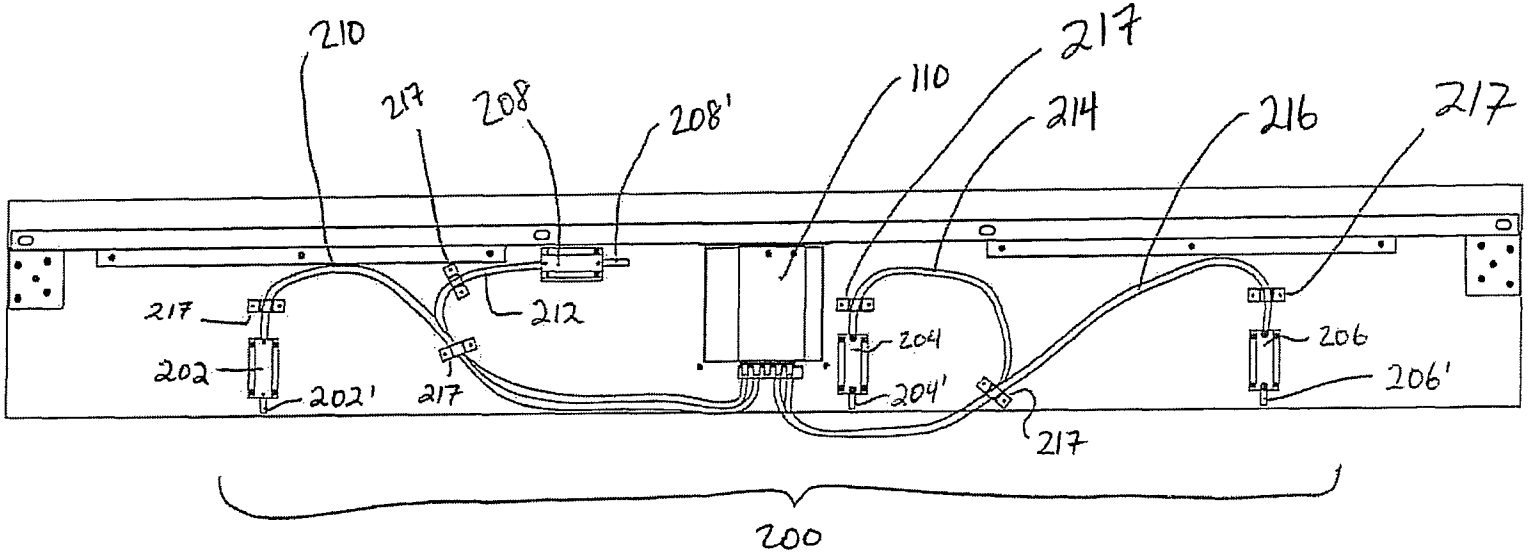
FIG. 2 is an interior portion of the storage cabinet illustrated in FIG. 1, in which an example of a locking system according to the present invention is illustrated.

FIG. 2 illustrates a part of an interior of storage cabinet 100. In particular, FIG. 2 illustrates an example of the locking system 200 of the present invention including a plurality of latch mechanisms 202, 204, 206, 208, and the central actuation mechanism (as was seen in FIG. 1) generally indicated at 110. In general, central actuation mechanism 110 is connected to the respective latch mechanisms 202, 204, 206, 208 by way of respective flexible connectors 210, 212, 214, 216. An example of a flexible connector in accordance with the present invention will be described later. A plurality of conventional cable mounts 217 may be optionally provided as needed to organize the flexible connectors and keep them lying generally against the interior surface of the storage cabinet.

In an example of the present invention, the latch mechanisms 202, 204, 206, 208 each include a protruding pin or other generally elongate latching member 202', 204', 206', 208', respectively, that is driven to selectively extend and retract in correspondence with operation of the central actuation mechanism 110. The respective latching members in turn selectively engage or latch with a cooperating part of drawers 109, 111, 113 and lid 103, respectively, when extended so as to prevent, in unison, the drawers and lid from being opened. The cooperating part may be, for example, a bore hole of appropriate diameter and depth suitably located opposite the latching member so as to receive the extended latching member therein so as to generally fix the drawer or lid fixed relative to the storage cabinet in a closed position. In another example, the cooperating part may be an eye ring suitably positioned in order to receive the extended latching member, or a metal bracket shaped to at least partly define an opening therethrough to receive the extended latching member.

Figure 4B:
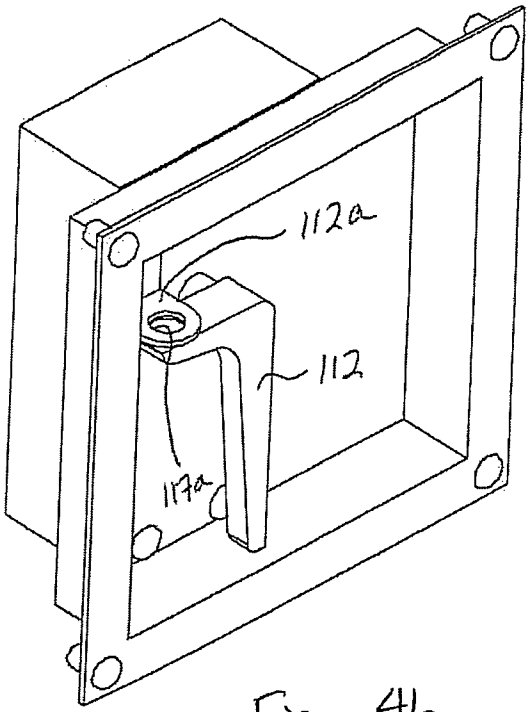
FIGS. 4*a* and 4*b* are an exploded perspective view and a perspective view of an exterior side of the central actuation mechanism of the present invention, opposite the structure(s) shown in FIGS. 3*a*-3*c*.

In FIG. 2, the interior side of central actuation mechanism 110 is schematically shown with a cover or protective casing (also in FIG. 4*b*). FIGS. 3*a*-3*c* illustrate certain structure details of the interior side of the central actuation mechanism 110 when uncovered.

In one example of the present invention as illustrated in FIGS. 3*a*-3*c*, the central actuation mechanism 110 includes a base plate 300 on which a drive member 302 is rotatably mounted. A cover plate 304 is mounted on base plate 300 and is shaped so as to be spaced away from (generally along a direction parallel to an axis of rotation of drive member 302) base plate 300, particularly in order to permit drive member 302 to be rotatably mounted between base plate 300 and cover plate 304. In one example of the present invention, at least a part of cover plate 304 is generally parallel to and spaced away from base plate 300 to define a space in which drive member 302 is disposed. Furthermore, the drive member 302 may be partly rotatably mounted on the base plate 300 and partly supported by cover plate 304. Base plate 300 and cover plate 304 may be attached to each other in any conventional manner suitable to space and environmental concerns, such as, without limitation, screws, bolts (see FIG. 3*c*), welding, gluing, etc.

Drive member 302 is illustrated as being circular, this being useful relative to addressing certain features of its rotational movement (as discussed below with reference to, for example, FIG. 3*b*). However, the particular shape of the drive member 302 is not overly critical to the present invention to the extent it satisfies space, size, and environmental limitations.

The axis of rotation of drive member 302 corresponds with the axis of rotation of pivoting handle 112 (see, for example, FIG. 4*a*) so that rotation of handle 112 drives rotation of drive member 302. In one example of the present invention, drive member 302 is provided with a central bore 306 (which is, for example, square in cross section in FIGS. 3*a*-3*c*) that is shaped to conformingly receive a mounting shaft 115 (see FIG. 4*a*) of handle 112 therein (see FIG. 4*b*). The shaft 115 may be fixed in place in central bore 306 if desired in any conventionally known manner. The shape of the handle 112 is not specifically critical to the present invention as long as it facilitates being manually gripped, so a knob, t-shaped handle, etc. could also be used.

Figure 4A:
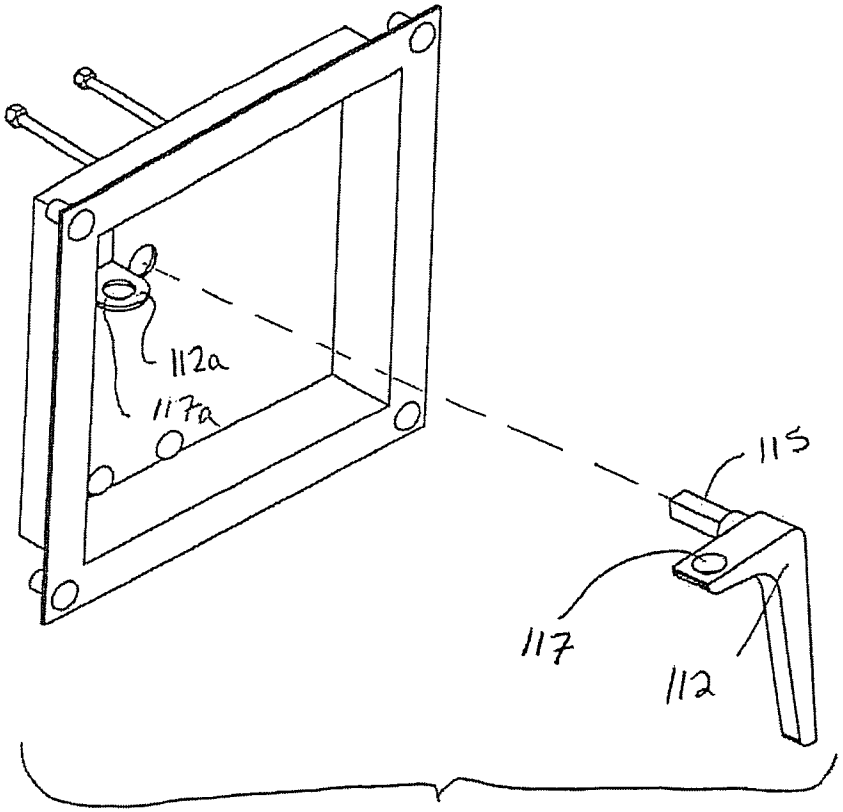

In an example of operation, handle 112 is rotatable through an arc of about 90° (compare FIG. 1 and FIGS. 4*a*-4*b*). Because handle 112 is mounted to drive member 302 as described above, drive member 302 also rotates through an arc of about 90°.

The present invention is not necessarily limited to manual actuation via a handle 112. The drive member 302 could also be selectively actuated via, for example, a selectively operated motor (not illustrated here) suitably coupled to the drive member 302.

Drive member 302 is provided with first and second nubs 308, 310 on diametrically opposed edges of drive member 302 which is circular by way of example in the figures. If the drive member 302 is not circular, the nubs 308, 310 are provided on diametrically opposite sides of an imaginary circle of a given radius centered on the axis of rotation of drive member 302 (and handle 112).

As seen in FIGS. 3*a*-3*c*, the drive member 302 may desirably be biased towards rotation by way of a spring member 312 that is under tension at the extreme rotational positions of the drive member 302/handle 112 (compare FIG. 1 and FIG. 4*b*). For example, a coil spring 312 may be fixedly attached at one end to an end portion of cover plate 304, and attached at its other end to a third nub 314 provided on drive member 302. Nub 314 is provided circumferentially about halfway (or about 90° in a rotational sense) between nubs 308, 310 such that when the drive member 302 is rotated, nub 314 travels along a lower (as seen in FIGS. 3*a*-3*c*; compare in particular FIGS. 3*b* and 3*c*) edge of drive member 302. According to the present invention, the spring member 312 is useful and desirable, but not critical to operation.

In a particular example of the present invention, nubs 308, 310 extend (along the direction of the axis of rotation of drive member 302) beyond the cover plate 304 (see FIG. 3*a*). Cover plate 304 is therefore desirably provided with arcuate cutouts 304*a* at its edges corresponding with the respective paths of travel of nubs 308, 310 in order to accommodate the movement of these protruding nubs 308, 310. The cutouts 304*a* are about 90° in circumferential arc, corresponding to the limits of rotation of the drive member 302. The opposing ends of cutouts 304*a* may therefore desirably act as rotation limiters when the nubs 308,310 abut them.

FIGS. 3*b* and 3*c* show drive member 302 in opposite rotational positions (that is, at opposite extremes of rotation). As will be understood taking the written description and drawings as a whole, FIG. 3*b* corresponds to a position in which latch members 202', 204', 206', 208' are retracted and thus an "unlatched" position; FIG. 3*c* is the opposite position in which the respective latch members are extended and thus a "latched" position.

When spring 312 is provided under tension as shown in FIG. 3*b*, drive member 302 is biased towards counterclockwise rotation (relative to FIG. 3*b*), into the position shown in FIG. 3*c*. By rotation of drive member 302, nub 314 moves in FIG. 3*c* to the position previously occupied by nub 308 (in FIG. 3*b*). As a result, in the arrangement illustrated in FIG. 3*c*, spring 312 now biases the drive member 302 into clockwise rotation, similar to the manner in which it biased the drive member 302 into counterclockwise rotation starting from FIG. 3*b*. Preferably the tension in spring 312 in the positions illustrated in FIGS. 3*b* and 3*c* is relatively light—enough to assist or encourage rotation of drive member 302/handle 112 without causing drive member 302/handle 112 to rotate independently without operation of the handle 112.

In a particular example of the present invention, the flexible connectors 210, 212, 214, 216 are flexible cables having a structure similar to conventional (and commercially available) cables used in bicycles and motorcycles to actuate brakes, gear shifting and clutch mechanisms, and the like. Most generally, cables of this type include a metal central cable (for example, braided steel wire) that is freely slidable along its length within an outer flexible rubber, plastic, polymer, etc. tubular sheath. That is, the metal central cable can be pulled/released at one end to cause the metal cable to move freely relative to its surrounding sheath. In a common example of such cables, the internal metal cable is provided at at least one end with an enlarged anchor or head mounted thereon or attached thereto, by which a cooperating engaging portion can more easily engage and retain the metal cable to provide a selective pulling action relative to the sheath. Cables of this type used in motorcycles are comparatively thicker (with respect to overall cross section) than those used in bicycle applications and may considered desirably more mechanically durable than bicycle cables.

In accordance with the foregoing, the central actuation mechanism further includes a cable pull member 316. The cable pull member is illustrated only in FIG. 3*c* for the sake of clarity.

In general, cable pull member 316 is rigid member pivotably mounted (in any known manner) relative to nub 310 (in order to provide a linear pulling force component while accommodating rotation of drive member 302). As drive member 302 (and thus, in pertinent part, nub 310) moves between the positions illustrated in FIGS. 3*b* and 3*c*, cable pull member 316 is correspondingly moved in opposite directions.

The distal end of cable pull member 316 (that is, opposite the end mounted on nub 310) is, for example, generally shaped into a hooked portion having a plurality of slots into which respective metal cables of, inter alia, flexible connectors 210, 212, 214, 216 are fitted. (An end of an extra fifth flexible connector 218 is illustrated in FIG. 3*c*, but this does not change the underlying explanation of the present invention.) Each of the metal cables of flexible connectors is provided with a respective anchor 210', 212', 214', 216' that is sized and arranged so that is retained by the distal hook-shaped cross section 316' of cable pull member 316. Ultimately, the distal end of cable pull member may have any mechanical structure suitable for assuredly engaging the respective metal cables. The proximal ends of the flexible connectors may be held in, for example, generally parallel orientation relative to each other by an additional mounting bracket 318 as seen in FIG. 3*c*.

When the drive member 302 is rotated into the position illustrated in FIG. 3*b*, the cable pull member 316 is retracted relative to the bracket 318 in which respective ends of the flexible connectors are fixedly mounted. Because the anchors of the respective metal cables of the respective flexible connectors are retained in the distal hook-shaped potion 316' of cable pull member 316, the metal cables are pulled within their respective sheaths until the drive member 302 is returned to the position shown in FIG. 3*c*, at which point tension on the metal cables is released.

Figure 5:
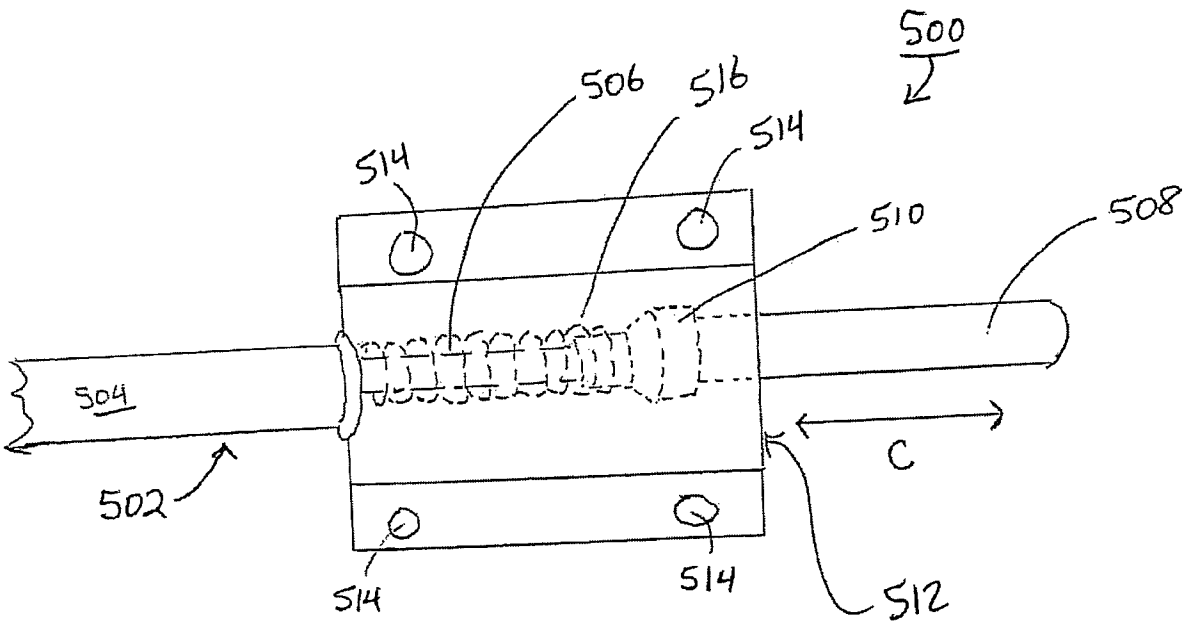
FIG. 5 is a plan view of an example of a latch mechanism according to the present invention.

FIG. 5 illustrates an exemplary structure of the latch mechanisms 202, 204, 206, 208 of the present invention.

An example of a latch mechanism 500 according to the present invention is connected to a flexible connector 502 of the type described above. The flexible connector 502 has an outer flexible sheath 504 as described above, and a freely slidable cable (for example, a metal cable) 506 disposed within the sheath 504. The opposite end of cable 506 from the latch mechanism 500 terminates at, for example, an anchor provided on an end of cable 506 in the manner illustrated in FIG. 3*c*. An elongate latching member 508 is fixedly attached to an end of cable 506 by a connector 510. Connector 510 may be, for example, a sleeve or ferrule having one end having a diameter suitable for receiving an end of cable 506 and a second end having a diameter having a diameter suitable for receiving an end of latching member 508, bearing in mind that these respective diameters may differ. Connector 510 may be attached to cable 506 and latching member 508 in any known matter suitable for the intended use, including without limitation, crimping the connector onto one or both of the cable 506 and latching member 508, adhesive, welding, etc.

The latching member 508 is preferably made of a generally rigid material that resists bending that is appropriate for the actual and commercial environment. As such, the latching member 508 could be made from, without limitation, hard polymer resin, plastic, metal, or even wood.

As seen generally in FIG. 2, each latch mechanism 500 includes a housing or shell 512 that is generally rigid and may be made from, for example, metal or hard plastic. In general, the flexible connector 502 is connected to the housing 512 such that some or all of the portion of the cable 506 extending outside of the sheath 504, a proximal end of latching member 508, and the connector 510 connecting the cable 506 and latching member 508 is disposed within the housing 512. In general, the latch mechanism 500 can be fixed in a desired location by screws, nails, staples, etc. driven through peripheral portions of housing 512 into an underlying surface. See, for example, fixation points 514 schematically indicated in FIG. 5.

When cable 506 is thusly connected to latching member 508, the latching member 508 can be extended and retracted relative to housing 512 (see arrow C in FIG. 5) in accordance with the tension selectively applied at the other end of the flexible connector via the operation of the central actuation mechanism 110 that selectively applies tension to the cable 506.

In one example of the present invention, a resilient biasing member, such as a coil spring 516 may be included in the latch mechanism 500 in order to bias the latching member 508 towards an extended direction. For example, the coil spring 516 may be provided such that a portion of cable 506 extends axially therethrough as seen by way of example in FIG. 5. One end of the coil spring may be disposed in abutting relationship with, for example, a proximal wall of housing 512. The other end of coil spring 516 may abut, for example, a radially outward extending portion of connector 510. The coil spring 516 may be in a neutral state of tension when the latching member 508 is at its fully extended position or it may be under relatively light compressive tension, such that retracting the latching member 508 (by pulling cable 506) compresses or further compresses coil spring 516 so that the latching member 508 is biased towards an extended latching position.

Returning to FIGS. 3*b* and 3*c*, it will be recalled that FIG. 3*b* corresponds to an unlatched position of the system, in which the respective latching members (like 508) are retracted from a latching position. The cable pull member 316 is pulled relative to the flexible connectors in FIG. 3*b*, such that the metal cables of the flexible connectors are pulled within their respective sheaths, and the respective latching members at the other ends of the flexible connectors are retracted, as was discussed with reference to FIG. 5.

When the central actuation mechanism 110 is put in the position shown in FIG. 3*c* (the latching position in which the latching members of the latch mechanisms extend), the cable pull member 316 is lowered such that tension on the metal cables is released. However it should be understood that the tension on the metal cables is merely released at the central actuation mechanism 110. For this reason, the provision of a biasing member, such as coil spring 516 in FIG. 5, assists in the latching members attaining an extended position when tension on metal cable 506 is released by the central actuation mechanism 110.

Returning to FIG. 5, latching member 508 may be arranged to protrude from a similarly sized bore or opening (not specifically illustrated in FIG. 5) formed in a corresponding end of housing 512. The bore may thus serve to allow the latching member 508 to extend and retract axially (that is, along arrow C) while at least partly limiting lateral movement of the latching member 508. Depending on the application in which the present invention is used, it may be useful to limit the extent to which the latching member 508 extends outside of housing 512 so as to limit bending forces on the latching member 508 that could snap the latching member (if, for example, one were to try and force open one of the drawers 109, 111, 113 when a respective latching member is extended into a latching position).

Although the present invention is described above with reference to certain particular examples for the purpose of illustrating and explaining the invention, it must be understood that the invention is not limited solely with reference to the specific details of those examples. More particularly, the person skilled in the art will readily understand that modifications and developments that can be carried out in the preferred embodiments without thereby going beyond the ambit of the invention as defined in the accompanying claims.

What is claimed is:

1. A locking system, comprising:

a central actuation mechanism; and a plurality of latch mechanisms each individually and operably connected to the central actuation mechanism via a respective flexible connector, each latch mechanism comprising an elongate latching member constructed and arranged to be selectively extended along a direction of extension of the elongate latching member into a latching position and retracted into a release position and in correspondence with an operation of the central actuation mechanism;

wherein each respective flexible connector comprises an inner flexible cable slidably disposed within an outer flexible tubular sheath, wherein a first end of the inner cable is connected with an end of the corresponding latching member and a second end of the inner cable is operably connected with the central actuation mechanism, such that extension and retraction of the latching member corresponds with extension and retraction of the inner cable within the outer sheath obtained by operation of the central actuation mechanism;

wherein each one of the latch mechanisms can be operably located relative to the central actuation mechanism independent of the location of any of the others of the latch mechanisms;

wherein the central actuation mechanism comprises:

a base plate;

a drive member rotatably mounted on the base plate; and a cable pull member pivotable on a peripheral portion of the drive member, the cable pull member including an engaging portion for engaging respective second ends of the inner cables of the flexible connectors opposite the first ends of the inner cables connected to the respective latching members;

wherein the drive member is rotatable between a latching position in which the latching members are extended and a release position in which the latching members are retracted, wherein the release position of the drive member is located such that it causes the cable pull member connected thereto to move in a direction that pulls the inner cables engaged by the engaging portion;

wherein the central actuation mechanism is selectively lockable in a state in which the plurality of latch mechanisms and the drive member are in the latching position.

2. The system according to claim 1, wherein the central actuation mechanism is constructed and arranged to selectively apply retractive tension to the inner cables so as to thereby cause the corresponding latching members to retract.

3. The system according to claim 2, wherein the latching members of the respective latch mechanisms are resiliently biased towards extension.

4. The system according claim 1, wherein the drive member is resiliently biased to rotate towards the release position from the latching position and towards the latching position from the release position.

5. The system according to claim 1, wherein the engaging portion of the cable pull member comprises a hooked portion having a plurality of slots formed therein and the second ends of the respective inner cables have an anchor, such that each respective inner cable is selectively received in a respective slot of the engaging portion and retained therein by the respective anchor.

6. The system according to claim 1, wherein the central actuation mechanism comprises a manually graspable rotatable handle connected to the drive member and located coaxial with an axis of rotation of the drive member.

7. The system according to claim 6, wherein corresponding portions of the base plate and the rotatable handle are constructed and arranged to receive an external lock device therethrough to lock the rotatable handle against rotation relative to the base plate.

8. A system for latching a respective first work member in a plurality of first work members relative to an adjacent respective second work member in a plurality of second work members at a corresponding plurality of respective latching locations, comprising:

a central actuation mechanism; and a plurality of latch mechanisms each mounted on a respective first work member and each individually and operably connected to the central actuation mechanism via a respective flexible connector, each latch mechanism comprising an elongate latching member constructed and arranged to be selectively extended along a direction of extension of the elongate latching member into a latching position in engagement with a respective second work member at a respective latching location, and retracted into a release position in correspondence with an operation of the central actuation mechanism;

wherein each respective flexible connector comprises an inner flexible cable slidably disposed within an outer flexible tubular sheath, wherein a first end of the inner cable is connected with an end of the corresponding latching member and a second end of the inner cable is operably connected with the central actuation mechanism, such that extension and retraction of the latching member corresponds with extension and retraction of the inner cable within the outer sheath obtained by operation of the central actuation mechanism;

wherein the central actuation mechanism comprises:

a base plate;

a drive member rotatably mounted on the base plate; and a cable pull member pivotable on a peripheral portion of the drive member, the cable pull member including an engaging portion for engaging respective second ends of the inner cables of the flexible connectors opposite the first ends of the inner cables connected to the respective latching members;

wherein the drive member is rotatable between a latching position in which the latching members are extended and a release position in which the latching members are retracted, wherein the release position of the drive member is located such that it causes the cable pull member connected thereto to move in a direction that pulls the inner cables engaged by the engaging portion;

wherein the central actuation mechanism is selectively lockable in a state in which the plurality of latch mechanisms are in the latching position.

9. The system according to claim 8, wherein at least some of the latching locations are displaced from each other along two orthogonal directions.

10. The system according to claim 8, wherein at least some of the latching locations are displaced from each other along three orthogonal directions.

11. The system according to claim 8, wherein the latching member is extended when in the latching position into engagement with a bore formed in the second work member.

12. The system according to claim 8, wherein the latching members of the respective latch mechanisms are resiliently biased towards extension.

13. The system according claim 8, wherein the drive member is resiliently biased to rotate towards the release position from the latching position and towards the latching position from the release position.

14. The system according to claim 8, wherein the engaging portion of the cable pull member comprises a hooked portion having a plurality of slots formed therein and the second ends of the respective inner cables have an anchor formed at least adjacent to their respective second ends, such that each respective inner cable is selectively received in a respective slot of the engaging portion and retained therein by the respective anchor.

15. The system according to claim 8, wherein the central actuation mechanism comprises a manually graspable handle fixed to and coaxially mounted with the drive member so as to permit manual rotation of the drive member between the latching and release positions.

16. The system according to claim 15, wherein corresponding portions of the base plate and the rotatable handle are constructed and arranged to receive an external lock device therethrough to lock the rotatable handle against rotation relative to the base plate.

17. The system according to claim 15, wherein the rotatable handle is provided with a key-operated lock cylinder therein for selectively locking the rotatable handle against rotation relative to the base plate.

18. A method for latching and locking a plurality of respective first and second work members relative to one another at a corresponding plurality of respective latching locations, comprising:

mounting a respective latch mechanism on the plurality of first work members, each latch mechanism being individually and operably connected to a central actuation mechanism via a respective flexible connector, each latch mechanism comprising an elongate latching member constructed and arranged to be selectively extended along a direction of extension of the elongate latching member into a latching position in engagement with the respective second work member at a respective latching location, and retracted into a release position in correspondence with an operation of the central actuation mechanism, wherein each respective flexible connector comprises an inner flexible cable slidably disposed within an outer flexible tubular sheath, a first end of the inner cable being connected with an end of the corresponding latching member and a second end of the inner cable being operably connected with the central actuation mechanism, such that extension and retraction of the latching member corresponds with extension and retraction of the inner cable within the outer sheath obtained by operation of the central actuation mechanism;

wherein the central actuation mechanism comprises:

a base plate;

a drive member rotatably mounted on the base plate; and a cable pull member pivotable on a peripheral portion of the drive member, the cable pull member including an engaging portion for engaging second respective ends of the inner cables of the flexible connectors opposite the first ends of the inner cables connected to the respective latching members;

wherein selectively operating the central actuation mechanism comprises selectively rotating the drive member between a latching position in which the latching members are extended and a release position in which the latching members are retracted, wherein the release position of the drive member is located such that it causes the cable pull member connected thereto to move in a direction that pulls the inner cables engaged by the engaging portion; and selectively operating and locking the central actuation mechanism in a state in which the plurality of latch mechanisms are in the latching position.

19. The method according to claim 18, wherein at least some of the latching locations are displaced from each other along two orthogonal directions.

20. The method according to claim 18, wherein at least some of the latching locations are displaced from each other along three orthogonal directions.

21. The method according to claim 18, wherein extending the latching member into the latching position comprises extending the latching member into engagement with a bore formed in the second work member.

22. The method according to claim 18, further comprising resiliently biasing the respective latching members towards extension.

23. The method according claim 18, further comprising resiliently biasing the drive member towards the release position from the latching position and towards the latching position from the release position.

24. The method according to claim 18, wherein the central actuation mechanism further comprises a rotatable handle for rotating the drive member, and corresponding portions of the base plate and the rotatable handle have selectively aligned eyelets, wherein selectively locking the central actuation mechanism in a state in which the plurality of latch mechanisms are in the latching position comprises passing an external lock device through the aligned eyelets and locking the external lock device so that the rotatable handle is fixed relative to the base plate.

25. The method according to claim 18, wherein selectively locking the central actuation mechanism in a state in which the plurality of latch mechanisms are in the latching position comprises providing a key-operated lock cylinder within the rotatable handle for selectively locking the rotatable handle against rotation relative to the base plate.

* * * * *